US008960988B2

(12) United States Patent
Chien

(10) Patent No.: US 8,960,988 B2
(45) Date of Patent: Feb. 24, 2015

(54) LED LIGHT WITH SPECIAL EFFECTS

(76) Inventor: Tseng-Lu Chien, Walnut, CA (US)

( * ) Notice: Subject to any disclaimer, the term of this patent is extended or adjusted under 35 U.S.C. 154(b) by 79 days.

(21) Appl. No.: 13/534,281

(22) Filed: Jun. 27, 2012

(65) Prior Publication Data

US 2013/0003417 A1 Jan. 3, 2013

Related U.S. Application Data

(62) Division of application No. 12/710,561, filed on Feb. 23, 2010, now Pat. No. 8,303,158.

(51) Int. Cl.

| | |
|---|---|
| ***H01R 33/00*** | (2006.01) |
| ***F21V 23/04*** | (2006.01) |
| ***F21S 8/00*** | (2006.01) |
| ***F21S 10/00*** | (2006.01) |
| ***G09F 9/33*** | (2006.01) |
| ***H05B 33/08*** | (2006.01) |
| *F21Y 101/02* | (2006.01) |

(52) U.S. Cl.

CPC ..... *F21V 23/04* (2013.01); *F21S 8/035* (2013.01); *F21S 10/00* (2013.01); *G09F 9/33* (2013.01); *H05B 33/0857* (2013.01); *F21Y 2101/02* (2013.01)

USPC ..... 362/646; 340/472

(58) Field of Classification Search

USPC ..... 340/472; 362/646

See application file for complete search history.

(56) References Cited

U.S. PATENT DOCUMENTS 5,644,291 A * 7/1997 Jozwik ..... 340/472
7,604,370 B2 10/2009 Dowdy et al.

* cited by examiner

*Primary Examiner* — Anabel Ton

(74) *Attorney, Agent, or Firm* — Bacon & Thomas, PLLC

(57) ABSTRACT

An LED light device with special effects utilizes persistence of vision theory to cause an LED(s) or LED array to change faster than the human eye response time of 1/16 to 1/24 second to display a special message, time, drawing, light patterns, or color changes. In addition, the light device may be provided with a sealed-unit arranged to receive a variety of eye-catching shades.

1 Claim, 5 Drawing Sheets

Special effects LED night light= Laser Bullom applications

Variety base with Preferrable LED light sources arrangement
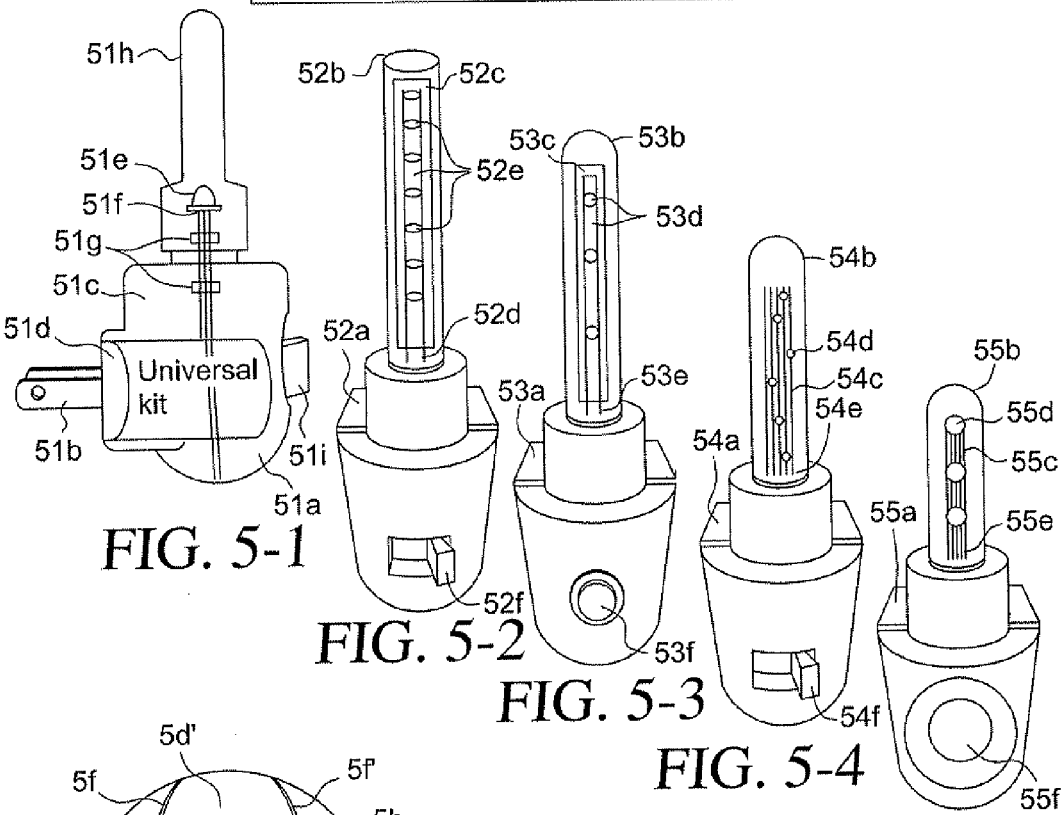
FIG. 5-1
FIG. 5-2
FIG. 5-3
FIG. 5-4
FIG. 5-5
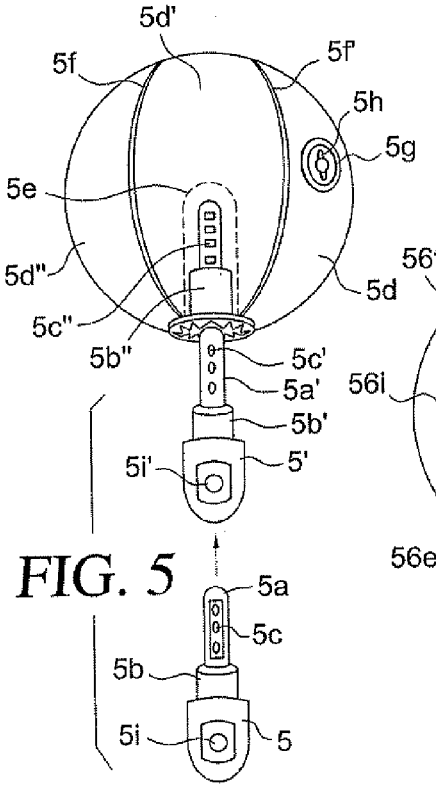
FIG. 5
Special Effect LED night light with Bullom shade made by Hologram or laser technical for bullom sheet
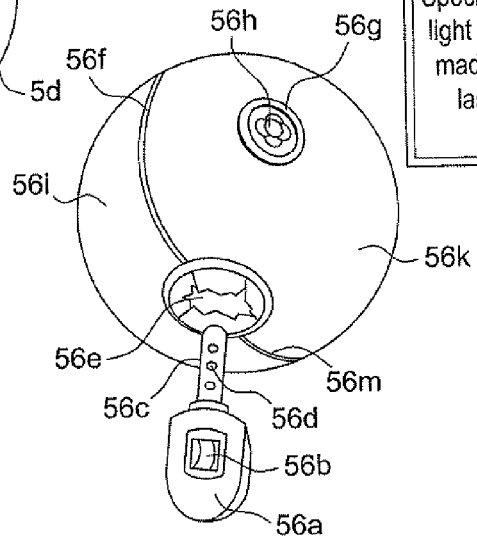
FIG. 5-6

Spin ball and axis

Spin light Bars

Spin Fan

Spin Disc

Spin LED fan into Punk light construction
FIG. 12
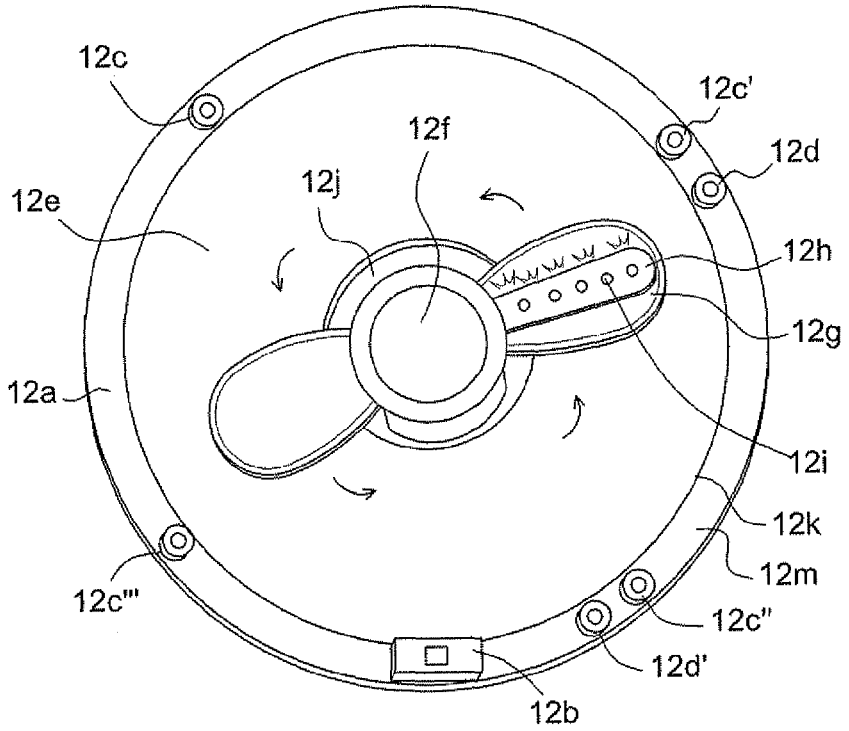
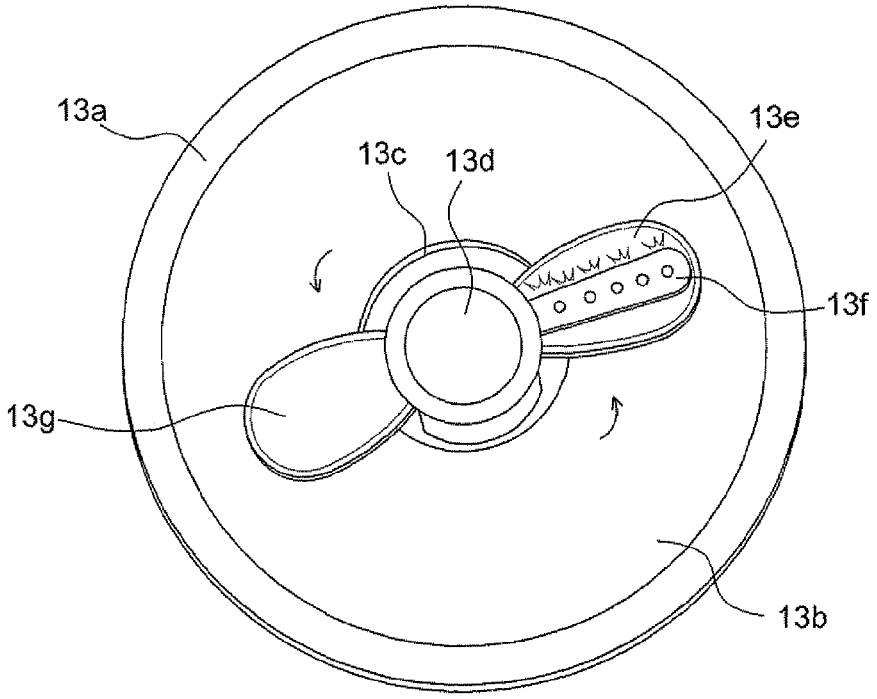
FIG. 13

LED LIGHT WITH SPECIAL EFFECTS

This application is a divisional of U.S. patent application Ser. No. 12/710,561, filed Feb. 23, 2010, and herein incorporated by reference.

BACKGROUND OF THE INVENTION

This application has subject matter in common with U.S. patent application Ser. Nos. 12/624,621, 12/622,100, 12/318,471, 12/318,470, 12/318,473, 12/292,153, 12/232,505, 12/232,035, 12/149,963, 12/149,964, 12/073,095, 12/073,889, 12/007,076, 12/003,691, 12/003,809, 11/806,711, 11/806,285, 11/806,284, 11/566,322, 11/527,628, 11/527,629, 11/498,874, 12/545,992, 12/806,711, 12/806,285, 12/806,284, 12/566,322, 12/527,628, 12/527,629, 12/527,631, 12/502,661, 11/498,881, 11/255,981, 11/184,771, 11/152,063, 11/094,215, 11/092,742, 11/092,741, 11/094,156, 11/094,155, 10/954,189, 10/902,123, 10/883,719, 10/883,747, 10/341,519, 12/545,992, and 12/292,580. The above-listed applications include disclosures related to light devices such as night lights powered by an AC outlet, battery, solar cell, or other power source, the light devices using optics theory to create a plurality of LED light images on a surface and which may contain more than one light source, function, or optics means.

The current invention applies the persistence of vision effect to a desktop or outlet plug-in LED light device to cause LED array light effects to be seen by viewers as light patterns such as a message display, time display, color changing display, word display, logo display, or advertisement display. It also provides a sealed-unit with self-test certification issued by laboratories for add-on shades to provide a more exciting and eye-catching LED device. Each light device has a desired power source, circuitry, switch, sensor, timer and and/or other related parts and accessories to cause the light to have a long life and be convenient to people to use.

The light device with special effects of the current invention may include one or more of the following 14 features:

1. The LED light device with special effects may include a special effects mechanism made up of at least one LED array arranged on a substrate, and at least one spin means for rotating the substrate means at a predetermined speed (RPM) about an axis extending from the spin means. The predetermined speed is preferably sufficient to provide a persistence of vision effect as described below.

The LED or LEDs of the light device will turn on and off according to a predetermined pattern, timing, color, function, and/or effects and controlled by an appropriate circuit, switch, sensor, timer, auto turn on and turn off, power source (DC, AC, or interchangeable power source), gear sets, motor, integrated circuit (IC), and/or conductive means to cause the light device to exhibit desired light patterns such as a message display, time display, color changing display, word display, logo display, and advertisement display.

The LED light device having persistence of vision properties includes a desktop or outlet plug-in type housing for any substrate, spin means, LED(s) or LED arrays, motor, switch, sensor, circuit, IC, and power source means provided in the light device.

The LED light device may further incorporate a vibration absorbing means to absorb all vibrations of the motor or spin means vibration when people put the device on a desk top or plug-in outlet.

2. The LED light device with special effects may include a sealed unit for at least one LED, the sealed unit having its own safety certification issued by a laboratory to meet the applicable safety standard and a receiving means to allow different shades to be added onto the sealed unit to obtain a final LED light device with special effects provided by the shades.

The added on shades may be made of plastic, paper, wood, a laser piece, a hologram piece, an air-bag, a balloon, assembly pieces, a light block out means, or a grill to cause the final LED light device with special light effects to have an eye-catching appearance. Because all electrical parts are in the already-certified sealed unit, the final LED light device does not need to pass any other laboratory's further tests. As a result, the shade can be made of any kind of material.

The final LED light device may use any power source, such as a battery, outlet, or power source that is interchangeable between DC and AC power sources for desk top or plug-in application.

3. The light device with special effects may be arranged to meet the requirements of persistence of vision theory to create an illusion based on the inertia of a human eye, which takes 1/16 to 1/24 second to respond to an image. When the LED or LEDs are turned off for periods of less than 1/16 to 1/24 second, the off time will not be noticed by a viewer and the image will appear to be steady.

4. The LED light device with special effects may be a tap light that is activated when a top cover is touched.

5. The LED light device with special effects may have a ball shape housing, and rotating means inside the ball to show the special effects, and spin means under the ball to provide a better appearance.

6. The spin means of the LED light device with special effects may be a motor with fan blades having a substrate to install the LED(s) or LED array within the said fan blade.

7. The spin means of the LED light device with special effects may be a motor with bars that include a substrate to install the LED(s) or LED array within the bars.

8. The spin means of the LED light device with special effects may be a motor with frame substrate to install the LED(s) or LED array within the frame.

9. The spin means of the LED light device with special effects may be a motor with a round disc substrate to install the LED(s) or LED array within the disc.

10. The spin means of the LED light device with special effects may be a motor with a geometric shape substrate to install the LED(s) or LED array with the geometric shape substrate.

11. The LED light device WITH special effects may include a switch, sensor, and/or timer means to control the circuit to provide predetermined functions.

12. The power source of the LED light device with special effects may come from a battery, USB outlet, generator, chemical power source, green power source, wind power source, outlet, extension cord, power strips or other power generator device(s).

13. The LED light device may be an LED light device with power saving features, including: at least one LED for a light source, and at least one housing having space to install circuit means, conductive means, electric components parts and accessories, switch means, sensor means, an integrated circuit (IC), and/or micro controller to connect with a conventional market-available power source to cause the said LED or LEDs to turn on and off according to a predetermined function, effects, duty cycle, color, and brightness, the LED or LEDs turning off for a certain percentage of each cycle that is shorter than the time required to meet the persistence of vision of human eye, i.e., more quickly than the human eye's response time of 1/24 to 1/16 second as noted above, so that the blinking LED or LEDs will appear to be continuously on.

14. The LED light device with special effects may have the additional cost saving feature, in case the power source is batteries, wherein the total batteries' voltage is less than the LED trigger voltage, the light device including voltage boosting components and related parts and accessories to increase the lower voltage to over the LED or trigger voltage.

BRIEF DESCRIPTION OF THE DRAWINGS

FIGS. 5-1 to 5-5 show a preferred construction for the sealed unit of FIGS. 1-4, with different functions, features and an interchangeable power source.

FIGS. 5, 5-6, and 5-7 show details of how to assemble the add-on shade to the sealed-unit of the preferred embodiment.

FIGS. 6 and 7 show a second preferred embodiment having a sealed unit with a grill or light block-out shade to cause the LED light beams to spread out to surrounding areas and provide electric wallpaper light effects.

FIGS. 12 and 13 illustrate one of the splendid light image effects created by the current invention an LED(s) or LED arrays that change faster than the slow human eye reaction time.

DETAILED DESCRIPTION OF THE PREFERRED EMBODIMENTS

Figure 1:
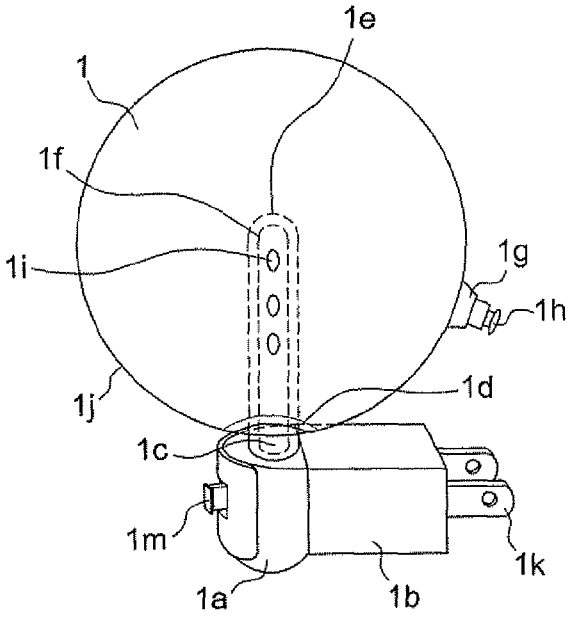
FIGS. 1 to 4 show a first preferred embodiment of the current invention, including a sealed-unit with its own laboratory test certification incorporated with add-on different shades made bags that can be filled up with air, liquid, miniature items, laser film, hologram film or other material piece(s).

As explained above, the current invention may apply the persistence of vision effect to enable the LED(s) or LED array to form light patterns such as color changing patterns, or a time display. The effect is based on the inertia of the human eye which has a response time of around 1/24 to 1/16 second. Hence, the LED(s) or LED array light can be controlled to change faster than the 1/24 (41.67 msec) to 1/16 (0.0625 sec) second response time so that even though an object moves faster than the human eye response time, the last image stays in the human eye and brain for a period of time. This effect is possible because the LED response time is very short, around 10 msec or less. Hence, if an object appears in front of the human eye for more than 16-24 pictures in a second, people will think all pictures are continuous. Hence, the current invention uses appropriate circuits, control means, an IC, and/or a micro controller to cause the LED or LEDs to blink much faster than 16-24 times (cycles) per second, with each cycle having a 10% turn-on duration and 90% turn-off duration to save up to 90% of the power consumption or increase battery life up to nine times more than would be the case with a full steady-on condition. This is a significant power saving for all battery power source applications. It will further be appreciated that new LED technology may be coming soon which will make the LED have an even quicker response time of less than 10 msec, perhaps 5 msec time or 2 msec to provide even more power saving. To thus adjust the turn-on and turn-off duration time for each cycle will enable more power saving devices to meet the green world concept.

To provide further cost saving in the case of a battery-powered unit, the preferred light device can use cheap batteries with a voltage lower than the LED trigger voltage and voltage boosting electric components, parts and accessories to raise the battery's lower voltage to trigger the LED or LEDs. This can reduce the quantity of batteries required and save substantial cost.

The current invention can include any of the 14 features described above, as described below in connection with FIGS. 1-13:

As shown in FIGS. 1 to 4, the first preferred embodiment of the current invention includes a sealed-unit with its own laboratory test certification and a plurality of different add-on shades made by bags which can be filled up with air, liquid, miniature items, laser film, hologram film or other material piece(s). The sealed unit (1*a*)(2*a*)(3*a*)(4*a*) of each of FIGS. 1-4 has different rear parts (1*b*)(2*b*)(3*b*)(4*b*) which have different lengths from the wall to the sealed-unit to accommodate the top balloon shades (1) (2) (3)(4). Each balloon shade has a center channel (1*e*) (2*e*)(3*f*)(4*e*) into which tube parts (1*f*)(2*f*) (3*g*) (4*f*) of the sealed unit are easily inserted Balloon before the balloon is filled up with air, liquid, and/or miniature stuff. After the air, liquid, and miniature stuff is filled into the balloon, the channels will become narrow and tightly hold the tube parts so that they are very difficult to move away. The LED or LEDs inside the tube parts may have a variety of arrangements such as the ones disclosed in the above-cited applications of the inventor. The tube can also be filled up with reflective material, air bubbles, LEDs, glitter, and air to provide the whole shade with a desired light performance.

Figure 2:
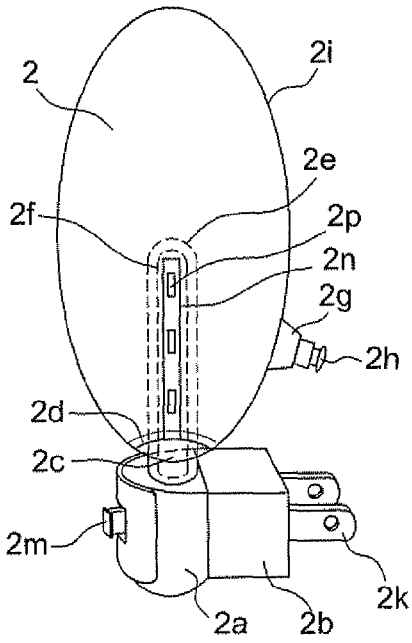
Figure 3:
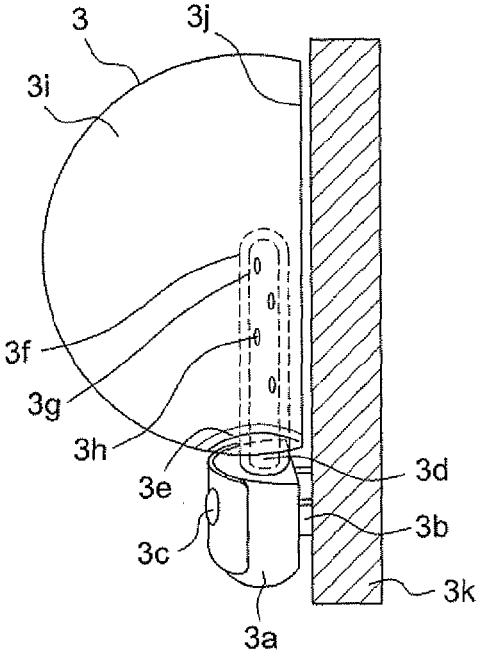
Figure 4:
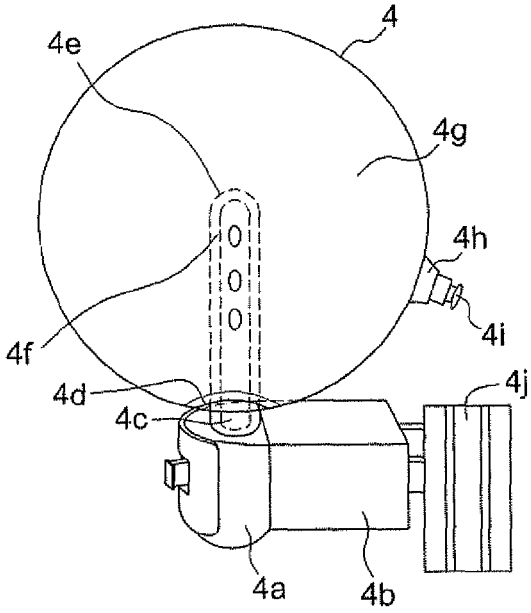
Figures 5, 6, 7:
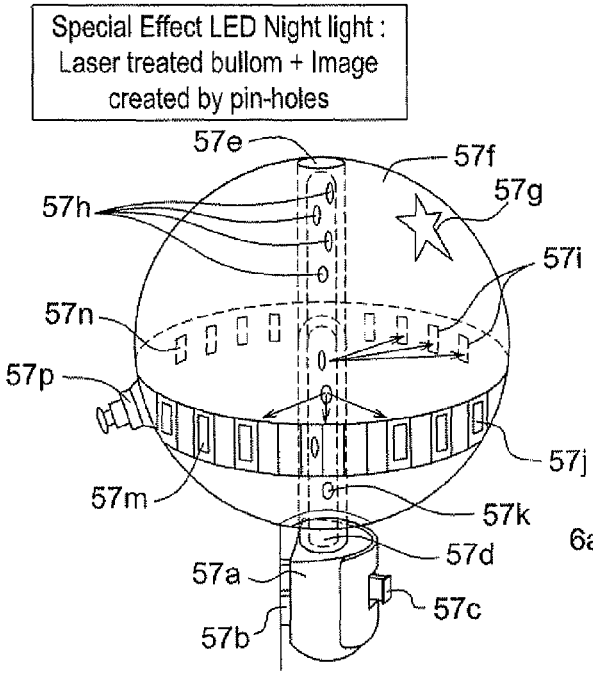
Figure 6:
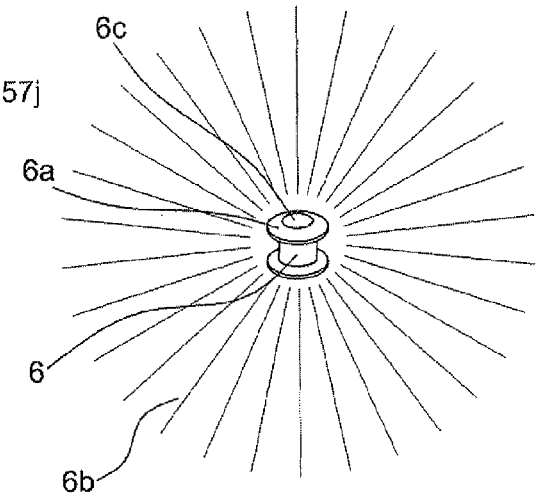
Figure 7:
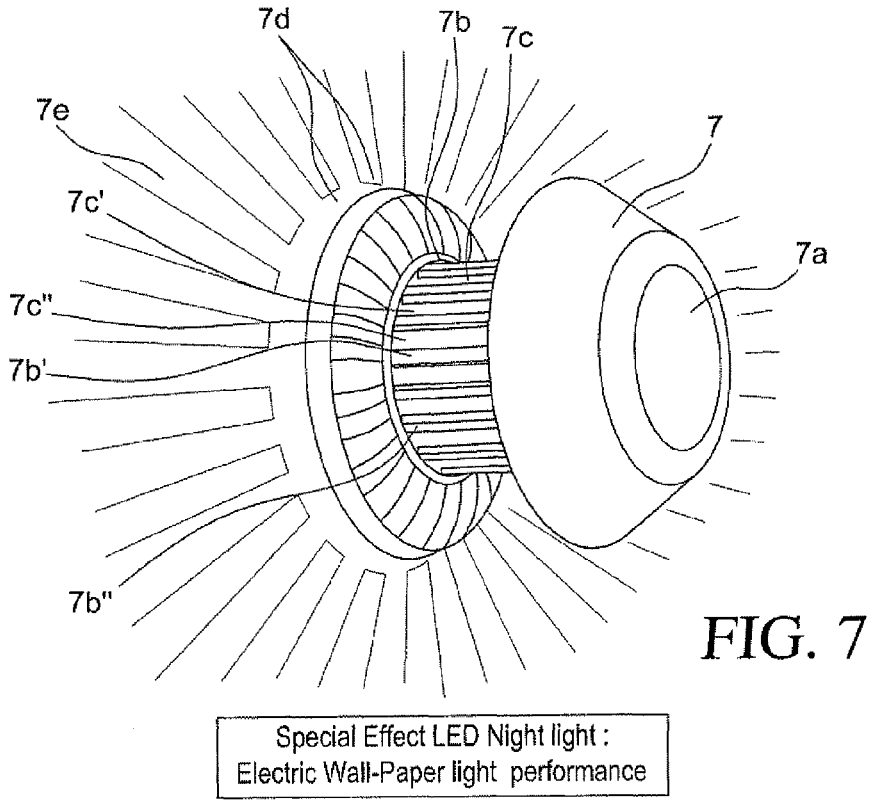

FIGS. 5-1 to 5-5 show light devices having sealed units and a variety of different functions. FIG. 5-1 shows a sealed unit in the form of an interchangeable power source (51*d*) including one LED (51*e*) on a base of tube part (51*h*), the sealed unit including a manual switch (51*i*). FIG. 5-2 shows a light device with tube part (52*b*), and a sealed unit having a manual switch (52*f*) and LEDs (52*e*) installed on an elongate printed circuit board (52*c*). The light device of FIG. 5-3 has a tube part (53*b*), auto sensor switch (53*f*), and LEDs (53*d*) installed on PCB (53*c*). The light device of FIG. 5-4 has a manual switch (54*f*) on the sealed unit and a tube part (54*b*) having a plurality of LEDs that face in different directions and are connected to conductive wires to provide multi-directional LED illumination. The light device of FIG. 5-5 has motion sensor switch (55*f*) on the sealed unit and a tube part (55B) having a plurality of LEDs installed on flexible electric wire cable.

The present invention may use the more than one optics means arrangements described in the inventor's U.S. patent application Ser. No. 11/806,284, which teaches outer optic means surrounding a tubular optics means containing LEDs.

FIGS. 5, 5-6, and 5-7 illustrate the use of laser or hologram film or pieces to form a balloon or assembly that can be added on the tube parts to provide a special effects LED light device.

FIGS. 6 and 7 show arrangements similar those of copending U.S. patent application Ser. No. 12/622,000 filed on Nov. 24, 2009 and directed to an "Interchangeable Universal Kits for all LED Lights."

Figure 8:
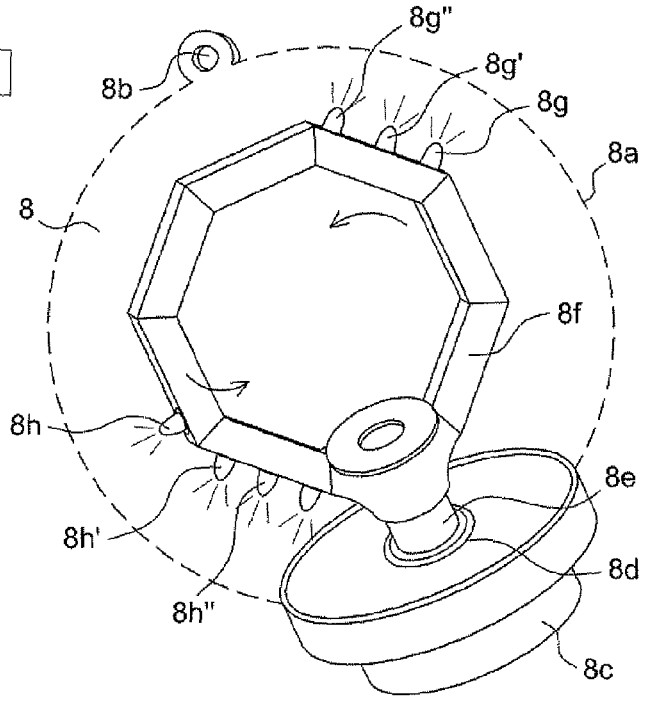
FIGS. 8, 9, 10, and 11 show a preferred embodiment having rotating means and spin means with a preferred geometric shape substrate are installed the LED(s) or LED array to form a message, light pattern, color changing pattern, and/or time display.

FIG. 8 shows LEDs (8*g*) (8*g*') (8*g*") and LEDs (8*h*) (8*h*') (8*h*") installed on a substrate (8*f*) assembled with spin means (not shown) inside a base housing (8*c*). The substrate is sealed within a transparent ball shaped housing (8*a*) to allow people to see the LEDs' light performance for desk top or outlet plug-in applications. The light device may have vibration absorbing means on the base (not shown) to vibrations when the light device is put on a desktop or plugged-into an outlet.

Figure 9:
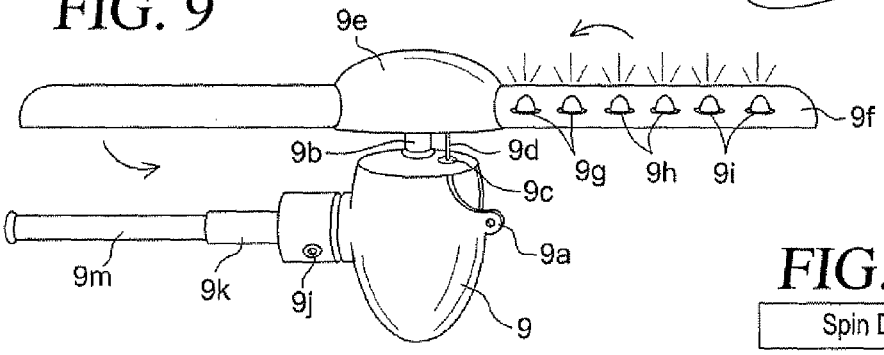

FIG. 9 shows a light device with a soft material substrate (9*f*) in a bar shaped design with a dome center area to deliver electricity by conductive means (9*d*) and a conductive axis (9*b*) of a spin means. The dome center area enables assembly of the bars with respect to the spin mean axis to cause the two bars to rotate when the switch (9*j*), sensor, or control means is activated. The plurality of LEDs (9*g*) (9*h*) (9*i*) can be any number to form a message display having a desired color, brightness, time, message, and words for presentation to a viewer. The LED or LEDs connect with a circuit board or micro controller for time display (such as PIC 16F84) having an integrated circuit (IC) that can display the time, message, or words according to conventional market available skill. The spin means (not shown) can be a motor and is sealed within a motor housing (9) with fastening means assembled with all related parts and accessories e for desktop or plug-in application to make the final LED device.

Figure 10:
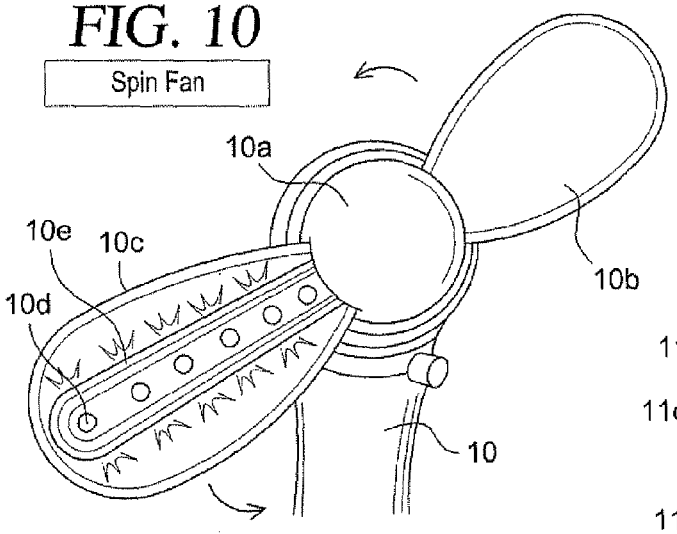
Figure 11:
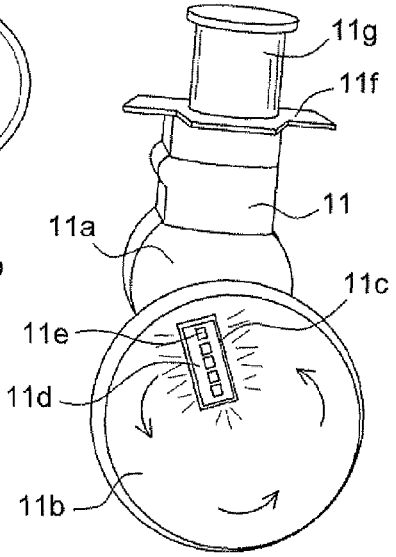

The light device of FIGS. 10 and 11 is similar to that of FIG. 9 and has the same LED or LEDs (10*d*) (11*e*) on a fan-blade (10*c*) or round disc (11*c*) arranged to rotate about the axis of a spin means to create a desired light performance. These light devices can be combined with a preferred housing to become a final LED light device as shown in FIGS. 12 and 13.

FIGS. 12 and 13 show how to arrange the preferred embodiments of FIGS. 7, 8, 9, and 10 into a housing to become a final LED device with special effects. The device may have any of a switch, sensor, timer, control means, circuit, micro controller, IC, conductive means, motor means and power source to enable it to have a special LED light performance.

In the above-described embodiments, preferred images are created when the light device is activated by a switch, sensor, control means, power source, and circuit means. The light device can have any kind of design, shape, and display. The geometric shape of the substrate and spin means that incorporate the LED(s) or LED array may also be varied to provide a desired display of time, messages, words, colors, or patterns.

Although preferred embodiments of the current invention have been described above, it will be appreciated that all alternative or equivalent devices, functions, skills, arrangements, and constructions may still fall within the current scope of the current invention.

I claim:

1. An LED light device with power saving features, comprising:

at least one LED arranged to provide a light source;

at least one housing with space to install control means for causing said at least one LED to turn on and off, the at least one LED being further controlled by components within said housing including at least one of a switch, sensor, timer, auto activation circuitry, and integrated circuit, said components being connected by conductive means to a power source, wherein the at least one LED is turned on and off by said control means in cycles to provide a persistence of vision effect, said cycles having a duration of less than the human eyes' response time of 1/16 to 1/24 second, and wherein said light device is a desk top or outlet plug-in light device.

* * * * *